US007951288B2

(12) United States Patent
Allen

(10) Patent No.: US 7,951,288 B2
(45) Date of Patent: May 31, 2011

(54) FUEL ENHANCEMENT SYSTEM FOR AN INTERNAL COMBUSTION ENGINE

(75) Inventor: John Allen, Hampshire (GB)

(73) Assignee: Jtech (GB) Limited, Hampshire (GB)

( * ) Notice: Subject to any disclaimer, the term of this patent is extended or adjusted under 35 U.S.C. 154(b) by 241 days.

(21) Appl. No.: 12/093,320

(22) PCT Filed: Nov. 8, 2006

(86) PCT No.: PCT/GB2006/004186

§ 371 (c)(1),
(2), (4) Date: May 9, 2008

(87) PCT Pub. No.: WO2007/054701

PCT Pub. Date: May 18, 2007

(65) Prior Publication Data

US 2008/0245741 A1 Oct. 9, 2008

(30) Foreign Application Priority Data

Nov. 10, 2005 (GB) ..... 0522928.1
Jun. 21, 2006 (GB) ..... 0612224.6

(51) Int. Cl.
*F02M 33/00* (2006.01)
*C10L 1/04* (2006.01)

(52) U.S. Cl. ..... 208/15; 208/16; 585/14; 210/695; 123/1 A; 123/536; 123/538

(58) Field of Classification Search ..... 585/14; 208/15, 16; 210/695; 123/536, 538
See application file for complete search history.

(56) References Cited

U.S. PATENT DOCUMENTS

| | | | | |
|---|---|---|---|---|
| 3,616,375 | A * | 10/1971 | Inoue | 204/157.61 |
| 4,282,100 | A * | 8/1981 | Kunishio et al. | 210/384 |
| 5,980,700 | A * | 11/1999 | Iritani | 204/157.62 |
| 6,763,811 | B1 * | 7/2004 | Tamol, Sr. | 123/536 |
| 6,851,413 | B1 * | 2/2005 | Tamol, Sr. | 123/536 |
| 7,603,991 | B2 * | 10/2009 | Rozim | 123/536 |
| 2005/0051144 | A1 * | 3/2005 | Champ et al. | 123/538 |
| 2006/0180500 | A1 * | 8/2006 | Gunnerman | 208/15 |

* cited by examiner

*Primary Examiner* — Ellen M McAvoy
(74) *Attorney, Agent, or Firm* — Kimberly A. Chasteen

(57) ABSTRACT

A method of for treating a hydrocarbon fuel comprises applying a plurality of shock waves to the fuel at a frequency and intensity such as to increase the combustion efficiency of the fuel. An apparatus for treating a hydrocarbon fuel comprises a fuel treatment chamber; an inlet for introducing a hydrocarbon fuel to be treated into the treatment chamber; an outlet for removing a treated hydrocarbon fuel from the treatment chamber; and a means for imparting a plurality of shock waves to fuel within the treatment chamber at a frequency and intensity such as to increase the combustion efficiency of the fuel. The apparatus is particularly suitable for installation in the fuel supply system of an internal combustion engine.

15 Claims, 2 Drawing Sheets

FUEL ENHANCEMENT SYSTEM FOR AN INTERNAL COMBUSTION ENGINE

CROSS REFERENCE TO RELATED APPLICATION

Figure 1:
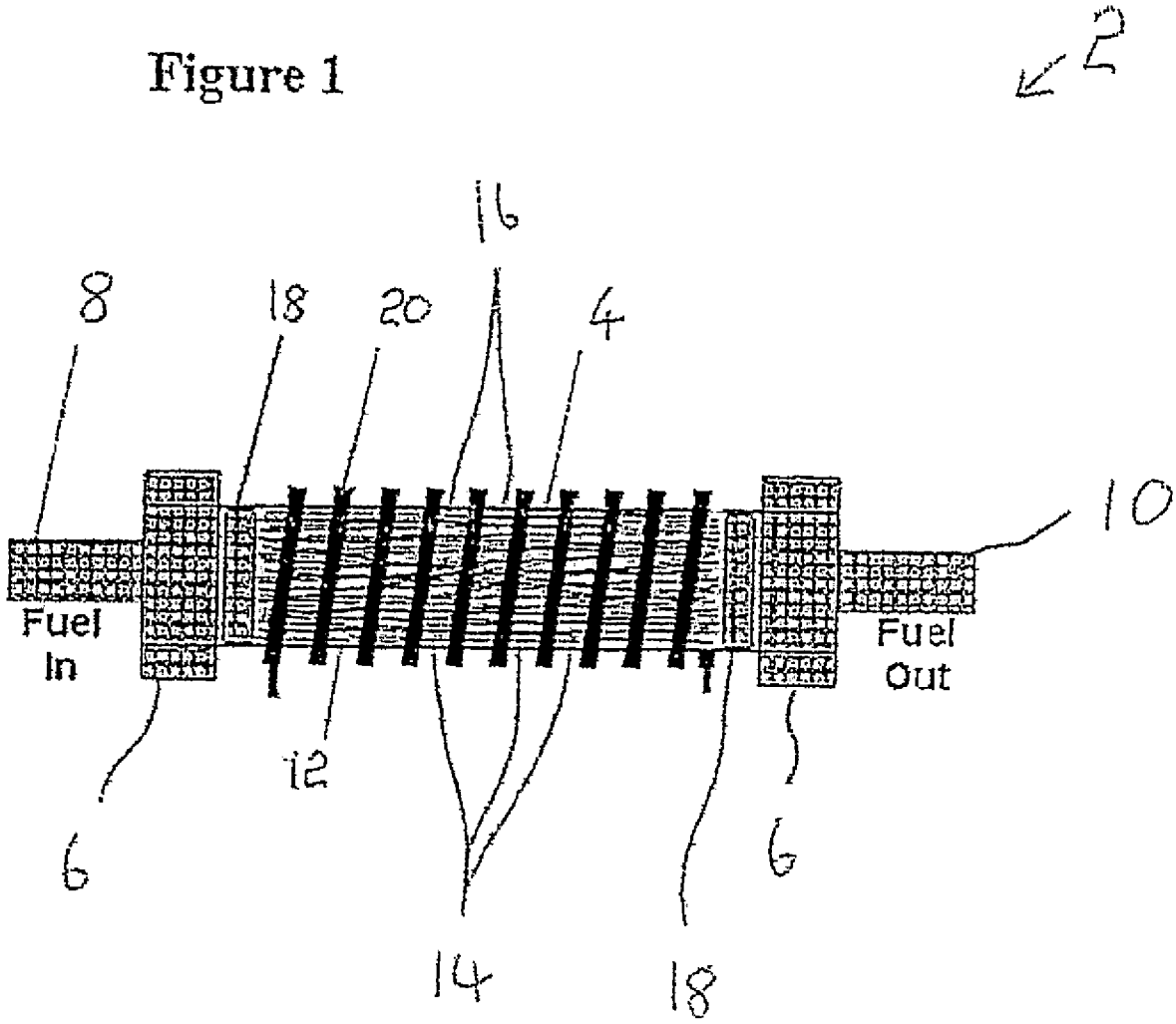

The present application claims priority from PCT Patent Application No. PCT/GB2006/004186 filed 8 Nov. 2006, GB Patent Application GB0522928.1 filed 10 Nov. 2005 and GB Patent Application No. GB0612224.6 filed 21 Jun. 2006.

The present invention relates to a method of enhancing a fuel for an internal combustion engine and to an apparatus for carrying out the same. In particular, the present invention relates to a method and apparatus for improving the combustive effectiveness and efficiency of a hydrocarbon fuel.

Hydrocarbon fuels for use in internal combustion engines are typically prepared by a distillation process to prepare fuels of the appropriate fraction from a starting material, such as crude oil. It is known that a hydrocarbon fuel taken directly from the distillation process will burn more effectively, and so return better engine efficiency, than fuel that has been stored for any length of time, particularly if stored in contact with the atmosphere.

It is also known that this deterioration of the fuel is largely due to the loss of volatile components, these being the lighter, more reactive hydrocarbon molecules.

It is further known that such degenerated fuel may be further treated, by various means, in order to further dismantle some of the longer chain molecules, for example by cracking or cleaving the longer hydrocarbon chains, thus releasing some of the more weakly attached lighter, more reactive, hydrocarbon molecules.

It is known that the presence of a small percentage of the more highly reactive molecules, will improve the overall burn efficiency of such a substance, when used as an internal combustion engine fuel.

There is a need for an improved method and system for the treatment of hydrocarbon fuels, in particular fuels for use in internal combustion engines, which can enhance the properties of the fuel, in particular the combustion efficiency of the fuel within the engine. It would be particularly advantageous if the method and system could be applied to a hydrocarbon fuel immediately before it is fed to the engine for combustion.

According to a first aspect of the present invention, there is provided a method of treating a hydrocarbon fuel, the method comprising applying a plurality of shock waves to the fuel at a frequency and intensity, and by this means, increase the combustion efficiency of the fuel.

The method operates by releasing from the hydrocarbon fuel to be treated, lighter hydrocarbon molecules. This in turn increases the performance of the fuel, in particular improving its combustion efficiency. This relates to an increase in the power obtained from the fuel. Alternatively, this relates to a decrease in the volume of fuel required to perform a given duty for the engine.

The method of the present invention is suitable for applying to any hydrocarbon stream or fraction that may be used as a fuel. The method is particularly suitable to treat fuels derived from the conventional processing of crude oil. However, the method is also suitable for the treatment of hydrocarbon fuels from other sources, such as synthetic fuels and so-called biofuels. The method is particularly suitable for the treatment of fuels for internal combustion engines, in particular gasoline, kerosene and diesel.

The method of the present invention is most advantageously applied to hydrocarbon fuels that have lost the lighter, more reactive fractions. The method is conveniently used to treat the hydrocarbon fuel immediately prior to its use. For example, the method may be applied to fuel in the feed line of an internal combustion engine, in particular in an automobile.

The shock waves may be applied to the fuel in any suitable manner. A preferred embodiment of the method of the present invention employs a magnetically responsive porous mass disposed in contact with the fuel to apply the shock waves. In a particularly preferred embodiment, the body is of a ferrous or other magnetically responsive material, which is caused to respond whilst in contact with the fuel, under the action of a pulsing magnetic field.

The shock waves are preferably applied to complex hydrocarbon fuels at more than one nominal frequency. The frequency and intensity of the shock waves applied are that which give rise to an increase in the lighter fractions. The suitable frequencies and intensity for a given fuel composition may thus be determined by routine experimentation within the capabilities of those skilled in the art. Theoretical models indicate that the required reactions may be instigated by nominal frequencies from less than 1 Kilo Hertz to many Giga Hertz.

In one preferred embodiment, the fuel is shocked at pulse repetition rates in the range of especially from 5 to 100 kilo Hertz. Several different rates within the aforementioned ranges may be applied to a given fuel composition, as required to free a variety of the lighter fractions of the fuel.

One preferred shock wave regime for use in the method of the present invention comprises providing shock waves at a nominal frequency, with the frequency being varied by being increased and/or decreased from the nominal value over a period of time. Suitable frequency variations are in the range of from 1 to 10%, more preferably 2 to 5%, of the nominal frequency. The frequency variations may be applied gradually or as step changes.

In a further preferred regime, shock waves are applied for a predetermined period of time, a so-called 'energized' period, followed by a period of inactivity or 'rest' period, during which shock waves are not applied to the fuel. Preferably, the energized and rest periods are substantially equal in length.

As noted hereinbefore, the fuel may be treated by the application of shock waves at a plurality of different nominal frequencies. In such a case, one preferred regime is to apply shock waves at a first nominal frequency, increased and/or decreased as described above, for one or more energized periods. Thereafter, fuel is subjected to shock waves at a second nominal frequency, which may also be increased and/or decreased as hereinbefore described, over one or more energized periods. Further treatments at still further different nominal frequencies may be applied. An extended rest period is preferably applied between each respective nominal frequency.

The length of the energized and rest periods for a given nominal frequency and the extended rest periods between successive different nominal frequencies will vary according to such factors as the rate of flow of fuel, the composition of the fuel, and the operating conditions. The optimum may be determined by routine experimentation.

For reasons of safety, the method of the present invention may include monitoring the temperature of the fuel. In particular, the temperature of the fuel after treatment may be monitored and compared with a predetermined or preset upper operating temperature. In the event that the fuel temperature exceeds the upper operating temperature, provision may be made to stop the method.

As already discussed, the method of the present invention provides a fuel having improved combustion properties. Accordingly, a further aspect of the present invention provides a treated hydrocarbon fuel produced by a method as hereinbefore described.

The present invention also provides a method of operating an internal combustion engine comprising treating the fuel being supplied to the engine as hereinbefore described.

According to a further aspect of the present invention there is provided an apparatus for treating a hydrocarbon fuel, the apparatus comprising:

a fuel treatment chamber;

an inlet for introducing a hydrocarbon fuel to be treated into the treatment chamber;

an outlet for removing a treated hydrocarbon fuel from the treatment chamber; and a means for imparting a plurality of shock waves to fuel within the treatment chamber at a frequency and intensity such as to increase the combustion efficiency of the fuel.

The apparatus may be constructed to be both simple and compact, allowing it to be installed in the fuel supply system for an internal combustion engine, for example in the fuel supply system of an automobile. In this way, fuel is treated immediately before it is used in the engine.

The apparatus comprises a chamber in which the fuel is treated, having an inlet and an outlet. The fuel treatment chamber, in a simple form, may be a length of conduit or pipe, through which the hydrocarbon fuel is cause to flow and in which the means for imparting the shock waves is disposed. It will be apparent that alternative configurations for the treatment chamber may also be provided.

Any suitable means may be employed to impart the shock waves to the fuel in the treatment chamber. One preferred embodiment comprises a mass in contact with the fuel in the treatment chamber, that is moved, so as to impart the shock waves to the fuel.

In a particularly preferred embodiment, the body is of or comprises a magnetically reactive material that may be mechanically influenced by the application of a suitable pulsed magnetic field. In this embodiment, the apparatus further comprises means for generating a magnetic field to intersect the treatment chamber and to pulse the magnetic field at the required frequency and to effect movement in the core to apply shock waves to the fuel of the required intensity. The magnetic field may be generated, for example, by a coil located around the treatment chamber and energized by an electric current under the control of a suitable circuit or control device.

In one arrangement, the body comprises a plurality of individual wires that may be caused to respond to an applied magnetic field. The plurality of wires may be of soft iron or other suitable magnetically reactive material. The reactive wires may be mixed with wires of other materials, in particular tin (as a reaction catalyst) and/or aluminium (as a paramagnetic field disruption agent), which have been found to improve the reaction process.

As noted above, for reasons of safety, the apparatus may also comprise means for monitoring the temperature of hydrocarbon fuel, in particular the temperature of fuel leaving the treatment chamber. Means for shutting off the device in the event the temperature exceeds a predetermined maximum operating temperature may be provided.

Suitable control means for controlling the operation of the apparatus may be assembled from components well known and commercially available in the art. The control means may be linked to exchange data and signals from the other control systems associated with an engine. In particular, the control means may be arranged to monitor the performance of the apparatus, for example from by determining the flow of fuel through the device, and to adjust the operation of the apparatus accordingly.

In a further aspect, the present invention provides an internal combustion engine comprising an apparatus as hereinbefore described. The apparatus is most conveniently located in the fuel supply system for the engine, such that fuel is treated immediately before being introduced into the engine.

Figure 2:
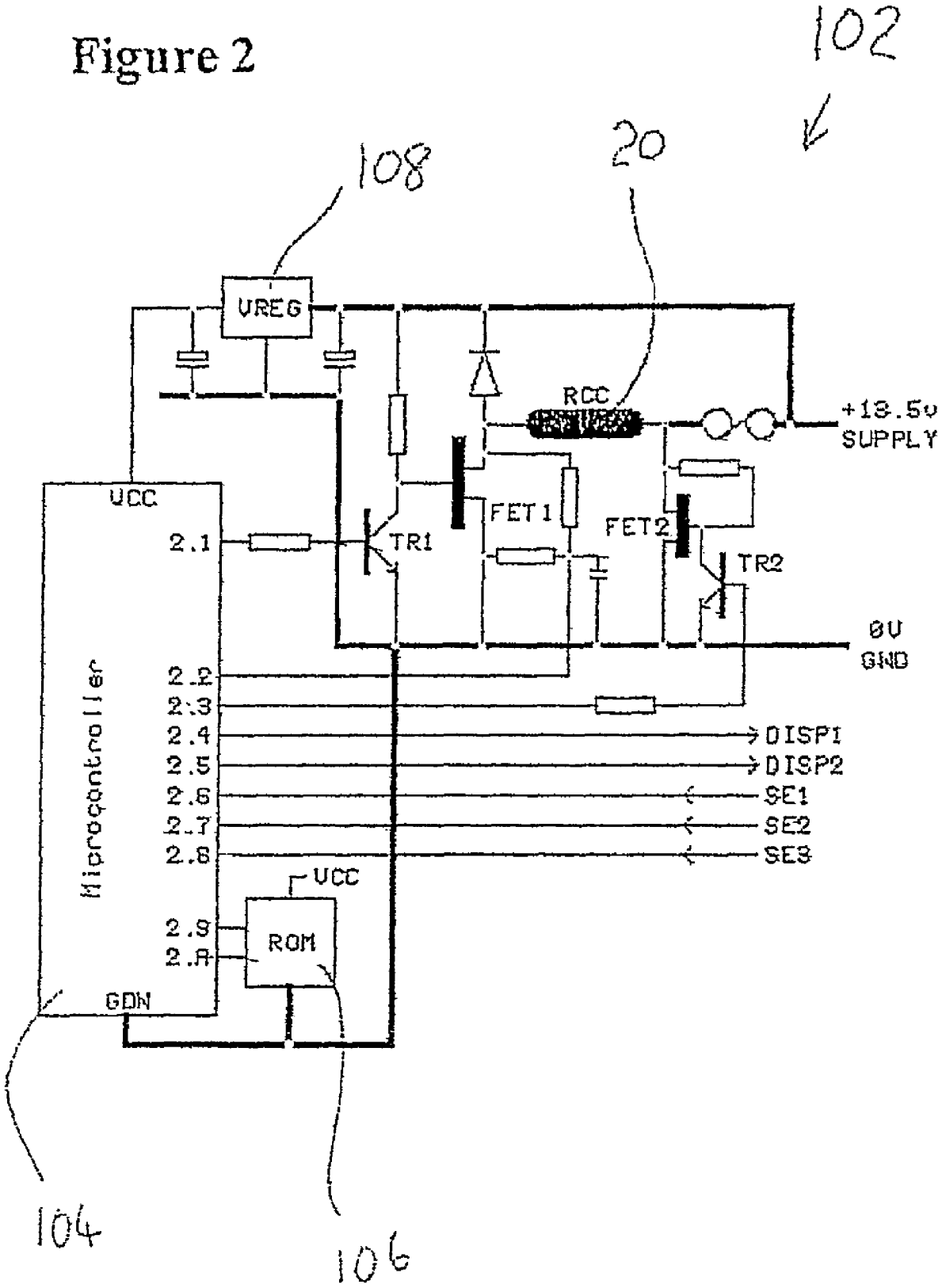

An embodiment of the present invention will now be described, by way of example only, having reference to the accompanying drawings, in which:

FIG. 1 is a cross-sectional view of an apparatus according to the present invention; and FIG. 2 is a circuit diagram of a controller for use with the apparatus of FIG. 1.

Referring to FIG. 1, there is shown a fuel treatment apparatus, generally indicated as 2. The apparatus 2 comprises a generally cylindrical fuel treatment chamber 4. The fuel treatment chamber 4 is of a suitable, non-magnetic material, such as a high temperature plastic, glass or other ceramic. The fuel treatment chamber 4 is provided at either end with a fluid-tight end cap 6 each with a pipe providing a fuel inlet 8 and a fuel outlet 10.

Within the fuel treatment chamber 4 is disposed a body 12 of fine magnetically reactive soft iron wires 14 extending longitudinally within the chamber 4. Interposed between the soft iron wires 14 are a smaller number of wires of tin and/or aluminium 16. The wires 14 and 16 of the body 12 are generally retained in position within the chamber 4 by plugs of coarse filter material 18. The soft iron wires 14 are free to respond to the action of an applied magnetic field.

A high current winding 20 of a low impedance conductor, such as copper, extends around the outside of the treatment chamber 4. The high current winding 20 is connected to a current source, the supply of which is controlled by a controller having the general configuration shown in FIG. 2.

Referring to FIG. 2, the controller, generally indicated as 102, comprises a microcontroller 104 arranged to provide a drive signal from output 2.1 to the high current winding 20 via a switching transistor TR1 and a high power field effect transistor FET1.

The microcontroller 104 has an input 2.2 for sensing the voltage from the power effect transistor FET1. This signal is used to shut off the apparatus and provide a suitable indication to a user, should the apparatus fault in a condition in which current is being supplied to the high current winding 20 during any period that the buffered processor 'power on' signal is in the 'power off' state. Shutdown of the apparatus is achieved in this respect by open-circuiting a slow blow fuse or other such device. A signal is sent from output 2.3 of the microcontroller 104 to a high power field effect transistor FET2, which conducts current, causing the fuse to blow.

The controller 102 also facilitates a number of display devices, which may be made to operate under signals from outputs 2.4 and 2.5 of the microcontroller 104.

Signals from the control system of the engine or vehicle to which the apparatus is attached, for example the fuel injection system, are received at inputs 2.6, 2.7 and 2.8 of the microcontroller 104, in order to regulate the signals applied to the device, proportionally to the rate of the fuel flow. These inputs may be used to receive signals from independent sensors at other positions in the apparatus or in the engine to which the apparatus is connected.

As shown in FIG. 2, terminals 2.9 and 2.A of the microcontroller 104 are connected to an external EEPROM device 106, which is used to provide data relative to the particular engine to which the unit has been connected, and also may be used to provide other data storage facilities.

Electrical current is supplied to the controller 102 by means of a voltage regulator 108, which may draw electrical power from the battery/generation system of the vehicle or plant.

The present invention will be further illustrated in the following working example.

EXAMPLE

A fuel treatment apparatus having the configuration shown in FIG. 1 and described above was installed in the fuel supply system of a commercially available normally aspirated gasoline engine driven ac generator.

The carburetor of this apparatus was gravity fed from a remotely placed fuel tank, situated upon a highly accurate, high resolution weighing device.

The electrical output of the generator was connected to the input of a well-insulated 10 gallon water heater.

The engine was operated under constant conditions, to heat identical quantities of water in the water heater.

For each of the multiple tests, the engine was operated for 15 minutes. After this time, the water in the water heater was allowed to stand for a further 10 minutes before a final temperature measurement was taken, the tank was drained, flushed, and the water replaced, between runs.

In all experiments the fuel to the inlet of the carburetor was caused to flow through the fuel treatment chamber of the fuel treatment apparatus.

Tests were conducted such that the only difference between alternative tests was the application of electrical power to the fuel treatment apparatus. Experiments where the apparatus in an energized state preceded the rest state, and vice versa, were carried out.

The fuel treatment apparatus was operated at three nominal pulse repetition rates: 19.42 kHz; 33.33 kHz; and 56.42 kHz. The signals were applied over successive periods, each followed by an extended rest period of no signal. Each nominal signal frequency was subjected to minor period variations (vibration), that is both increases and decreases in frequency of from 1 to 5%, with successive changes in frequency being separated by a rest period substantially equal in length to the preceding energized period.

The results of these tests are set out in the Table.

TABLE

| Experiment No. | Fuel Treatment | Gasoline Consumed (oz) | Start Temp. of water (F.) | End Temp. of water (F.) | Temp Difference (F.) | CR |
|---|---|---|---|---|---|---|
| 1 | OFF | 12.5 | 59.5 | 75.5 | +16.0 | 1.28 |
| 2 | ON | 11.5 | 59.9 | 77.6 | +17.7 | 1.54 |
| 3 | OFF | 12.0 | 59.3 | 75.3 | +16.0 | 1.33 |
| 4 | ON | 11.5 | 59.9 | 77.8 | +17.9 | 1.56 |

CR - ratio of temperature difference (F.)/Gasoline consumed (oz)

Referring to the data set out in the Table, it can be seen that the treatment of the gasoline fuel significantly increased performance of the engine. In particular, comparing experiments 1 and 2, it can be seen that over the 15 minute operating period of the engine, the 10 gallons of water was heated to 1.7 F higher when the fuel was treated, compared to fuel without treatment. It will also be noted that this increased temperature was achieved using significantly less fuel. Using the CR figures, this represents an improvement of 16.83% in the efficiency of the engine.

Similarly, comparing experiments 3 and 4, it can be seen that an additional 1.9 F temperature rise was achieved over the operating time, again with a significant decrease in fuel consumption. Using the CR figures, this represents an improvement of 14.34% in the efficiency of the engine.

As all experiments were operated under a standard set of conditions, the increase in engine performance may be attributed to the altered properties of the fuel as a result of the treatment.

The invention claimed is:

1. A method for treating a hydrocarbon fuel, the method comprising applying a plurality of shock waves to the fuel at rates and intensities such as to increase the combustion efficiency of the fuel, the shock waves being applied to the fuel by means of the movement of a magnetically responsive mass in contact with the hydrocarbon fuel, the relative movements of the mass being induced by applying a pulsing magnetic field to the mass; wherein the shock waves are applied to the fuel at a plurality of different nominal frequencies.

2. The method according to claim 1, wherein the hydrocarbon fuel is a fuel for an internal combustion engine.

3. The method according to claim 1, wherein the hydrocarbon fuel is gasoline, kerosene or diesel.

4. The method according to claim 1, wherein the mass comprises a plurality of soft iron wires.

5. The method according to claim 1, wherein the shock waves are applied to the fuel at a nominal frequency in the range of from 1 kiloHertz to 5 megahertz.

6. The method according to claim 5, wherein the nominal frequency is in the range of from 2 kiloHertz to 1 megahertz.

7. The method according to claim 6, wherein the nominal frequency is in the range of from 5 to 100 kiloHertz.

8. The method according to claim 1, further comprising monitoring the temperature of the fuel.

9. The method according to claim 8, wherein the method comprises applying the shock waves to the fuel only when the fuel is at a temperature below a predetermined threshold temperature.

10. The method according to claim 1, applied to the fuel being fed to an internal combustion engine.

11. Apparatus for treating a hydrocarbon fuel, the apparatus comprising:

a fuel treatment chamber;

an inlet for introducing a hydrocarbon fuel to be treated into the treatment chamber;

an outlet for removing a treated hydrocarbon fuel from the treatment chamber; and a means for imparting a plurality of shock waves to fuel within the treatment chamber at a rate and intensity such as to increase the combustion efficiency of the fuel, the means comprising:

a magnetically responsive mass within the treatment chamber for contacting the fuel being treated;

means for generating a magnetic field to interact with the mass; and means for pulsing the magnetic field to cause the mass to mechanically vibrate and operable at a plurality of nominal frequencies.

12. Apparatus according to claim 11, wherein the mass comprises a plurality of wires.

13. Apparatus according to claim 11, further comprising a means for measuring the temperature of the hydrocarbon fuel.

14. Apparatus according to claim 13, further comprising a means for stopping operation of the apparatus if the temperature of the fuel exceeds a predetermined threshold.

15. An internal combustion engine comprising an apparatus according to claim 11.

* * * * *